US007383766B2

(12) United States Patent
McIntosh et al.

(10) Patent No.: US 7,383,766 B2
(45) Date of Patent: Jun. 10, 2008

(54) COAL DEWATERING SYSTEM AND METHOD

(75) Inventors: Malcolm John McIntosh, Donvale (AU); Danh Quan Huynh, Burwood (AU)

(73) Assignee: MTE Research Pty Ltd (AU)

( * ) Notice: Subject to any disclaimer, the term of this patent is extended or adjusted under 35 U.S.C. 154(b) by 726 days.

(21) Appl. No.: 10/487,696

(22) PCT Filed: Aug. 26, 2002

(86) PCT No.: PCT/AU02/01155

§ 371 (c)(1),
(2), (4) Date: Jul. 9, 2004

(87) PCT Pub. No.: WO03/018716

PCT Pub. Date: Mar. 6, 2003

(65) Prior Publication Data

US 2004/0237809 A1 Dec. 2, 2004

(30) Foreign Application Priority Data

Aug. 29, 2001 (AU) ..... PR7340
Apr. 15, 2002 (AU) ..... PS1741

(51) Int. Cl.
*B30B 9/06* (2006.01)

(52) U.S. Cl. ..... 100/92; 100/116; 100/126; 100/215; 100/240; 100/244; 44/550; 44/594; 44/597; 44/626; 210/770

(58) Field of Classification Search ..... None
See application file for complete search history.

(56) References Cited

U.S. PATENT DOCUMENTS

| | | | | |
|---|---|---|---|---|
| 216,856 | A * | 7/1879 | Hudson | |
| 1,071,020 | A * | 8/1913 | Bartholomew | |
| 2,331,126 | A * | 10/1943 | Loomis | 34/70 |
| 2,362,701 | A * | 11/1944 | Koehring | 29/34 R |
| 2,830,530 | A * | 4/1958 | Powell | 100/98 R |
| 3,070,003 | A * | 12/1962 | Stacy | 100/51 |
| 3,168,033 | A * | 2/1965 | Hansen | 100/179 |
| 3,552,031 | A * | 1/1971 | Evans et al. | 34/349 |
| 3,580,166 | A * | 5/1971 | Longo | 100/49 |

(Continued)

FOREIGN PATENT DOCUMENTS

| | | |
|---|---|---|
| DE | 347 361 | 1/1922 |

(Continued)

*Primary Examiner*—Robert James Popovics
(74) *Attorney, Agent, or Firm*—Andrus, Sceales, Starke & Sawall, LLP

(57) ABSTRACT

The invention relates to a coal dewatering system, method and apparatus. The dewatering system includes a preheater vessel (82) having a chamber (101) for heating coal, an inlet (84) to permit the passage of coal into the chamber (101), and an outlet (86) for permitting the passage of coal from the chamber (101). The dewatering vessel also includes a heating mechanism (98) associated with the preheater vessel (82) to heat coal contained in the chamber (101) and a non-return valve (92) to substantially prevent heated coal removed from the preheater chamber (101) via the outlet (86) from re-entering the preheater vessel (82) via the outlet (86). The dewatering system further includes a dewatering unit (60) adapted to receive the heated coal from the outlet (86) via the non-return valve (92) and to thereby dewater the coal.

14 Claims, 5 Drawing Sheets

U.S. PATENT DOCUMENTS

| | | | | | |
|---|---|---|---|---|---|
| 3,660,054 | A | | 5/1972 | Rieve | |
| 3,688,686 | A | * | 9/1972 | Ligh et al. | 100/52 |
| 3,736,083 | A | * | 5/1973 | Mitchell | 425/78 |
| 3,992,784 | A | | 11/1976 | Verschuur et al. | |
| 4,208,188 | A | * | 6/1980 | Dick, Jr. | 44/596 |
| 4,285,140 | A | | 8/1981 | van Raam et al. | |
| 4,343,233 | A | * | 8/1982 | Burgin | 100/116 |
| 4,346,653 | A | * | 8/1982 | Rodak | 100/37 |
| 4,347,137 | A | * | 8/1982 | Dick, Jr. | 210/329 |
| 4,371,376 | A | * | 2/1983 | Dick, Jr. | 210/767 |
| 4,389,928 | A | * | 6/1983 | Burgin | 100/37 |
| 4,501,539 | A | * | 2/1985 | Fenton et al. | 425/84 |
| 4,514,912 | A | * | 5/1985 | Janusch et al. | 34/393 |
| 4,630,535 | A | * | 12/1986 | Haygreen | 100/127 |
| 4,646,633 | A | * | 3/1987 | Falguieres | 100/37 |
| 4,702,745 | A | | 10/1987 | Kamei et al. | |
| 5,001,975 | A | * | 3/1991 | Finden | 100/38 |
| 5,026,475 | A | * | 6/1991 | Stuntz et al. | 208/403 |
| 5,071,540 | A | * | 12/1991 | Culross et al. | 208/414 |
| 5,146,848 | A | * | 9/1992 | Dufour | 100/345 |
| 5,236,583 | A | * | 8/1993 | Wang | 210/181 |
| 5,263,411 | A | * | 11/1993 | Gourdol | 100/98 R |
| 5,366,626 | A | * | 11/1994 | Pierson | 210/216 |
| 5,658,357 | A | * | 8/1997 | Liu et al. | 44/550 |
| 5,862,746 | A | | 1/1999 | Bielfeldt | |
| 5,863,429 | A | * | 1/1999 | Bahr | 210/385 |
| 5,887,514 | A | | 3/1999 | Bielfeldt et al. | |
| 5,900,139 | A | | 5/1999 | Bielfeldt | |
| 5,961,827 | A | * | 10/1999 | Bahr | 210/387 |
| 6,110,388 | A | * | 8/2000 | Norais et al. | 210/770 |
| 6,749,783 | B2 | * | 6/2004 | Everett | 264/109 |
| 2004/0237809 | A1 | * | 12/2004 | McIntosh et al. | 100/117 |

FOREIGN PATENT DOCUMENTS

| | | |
|---|---|---|
| DE | 459 086 | 4/1928 |
| EP | 0022013 | 1/1984 |
| GB | 2 065 164 | 6/1981 |

* cited by examiner

COAL DEWATERING SYSTEM AND METHOD

CROSS-REFERENCE TO RELATED APPLICATIONS

This application is the U.S. national stage application of International Application PCT/AU02/01155, filed 26 Aug. 2002, which international application was published on 6 Mar. 2003, as International Publication WO 03/018716 in the English language. The International Application claims priority of Australian Patent Application No. PR 7340, filed 29 Aug. 2001 and Australian Patent Application No. PR 1741, filed 15, Apr. 2002.

FIELD OF THE INVENTION

The present invention relates to a method and aparatust for dewatering a high moisture, carboniferous solid such as coal, in particular brown coal or lignite.

BACKGROUND OF THE INVENTION

Lignite (brown coal) is a significant Australian energy resource (major deposits are located throughout Victoria, South Australia and Western Australia). The moisture content of lignite, commonly in the range 60-70% wt, w.b., is generally considered as the major economic barier to its commercial exploitation. Unfortunately, this high moisture lignite is the only solid fossil-fuel resource in Victoria. Taking advantage of the low cost of mining and the huge readily recoverable resources containing several hundred years of supply, Victoria has utilised this high-moisture low energy resource to generate the majority of its electrical power over the last eighty years. In addition, it is a widely accepted view that the coal reserves will remain important to the State economy in the many years to come.

The thermal conversion efficiency of lignite is however rather low, which is exacerbated by the high moisture content of the fuel, leading to higher levels of greenhouse gas emissions than from plants of similar capacity fuelled with gas or even high-rank black coal. Reducing moisture or pre-drying is therefore the first and most important step in developing cost-effective technologies for power generation from this abundant resource and particularly for increasing the efficiency of existing plant.

Most of the total water (up to 70%, as-received basis) in the as-mined lignite is contained in the capillary macrostructure and colloidal microstructure within the coal together with a small portion bound to the solid organic structure through electrostatic attraction and adsorption. Numerous techniques have been investigated for drying high-moisture coals, which can be broadly classified into two main categories—thermal drying and mechanical dewatering.

The thermal methods can be further divided into two groups—evaporative and non-evaporative. Evaporative processes involve applying heat to vaporise water from coal at atmospheric pressure. The heat transfer medium is usually hot flue gas, air or steam, applied either directly or indirectly. The energy requirements of these thermal drying processes involve inputs in the order of 3000-4000 kJ per kg of removed water, which are far greater than the enthalpy required for the evaporation of clean water. Non-evaporative thermal drying (also known as thermal dewatering) methods use steam or hot water to heat the coal up to the corresponding saturated steam pressure and the coal water is then removed as a liquid before cooling and/or depressurising.

The energy requirements for non-evaporative thermal drying processes are much less (e.g. 1600-1800 kJ/kg of water) compared to the evaporative methods. This is possible as the enthalpy for evaporating the water can be dispensed through the use of increased pressure and the corresponding saturated steam temperatures to remove the moisture in the liquid form. The Fleissner and Hydro-Thermal Drying (HTD) processes are the most common non-evaporative thermal drying methods in use today.

Mechanical dewatering methods refer to the application of mechanical pressure to separate moisture from raw materials. The dewatered product can generally be created with a significantly lower energy input compared to known thermal methods. Mechanical methods have been widely used for fibrous materials (pulp and paper, citrus peel, sewage sludge, food product, animal waste, etc.) and to a lesser extent for coal slurries containing a high proportion of fines, such as minerals and coal dressings. Screw and disc presses have been investigated for the dewatering of brown coal in laboratory-scale test rigs. Banks P. J. & Burton D. R. 'Press dewatering of brown coal', Part 1, Drying Technology 7(2), 1989 discloses a study of the feasibility of upgrading Victorian brown coal via mechanical dewatering of as-mined coal and coal water slurries. Using a water permeable cell they found that the compressibility and permeability of solid coal decreased greatly during mechanical expression and that the coal displayed viscoelastic properties. Using pressures up to 140 bar, the product moisture content reduced to below 80% (by weight on a dry basis) and was shown to be strongly dependent on the applied pressure, irrespective of the initial moisture content. The coal became consolidated and the volume change recorded during the consolidation was largely irreversible. The moisture in the expressed coal was shown to decrease linearly with increasing pressure when plotted on a semi-logarithmic scale. Murase T et al. 'Press dewatering of brown coal', Part 2, Drying Technology 7(2), 1989 discloses a study of both batchwise and continuous dewatering processes using screw presses. The degree of dewatering was shown to be dependent on both the screw rotational speed and residence time of the material inside the barrel. The extent of dewatering was only significant when the screw speed was below a critical value (usually below 10 rpm) which was in turn determined by the equipment and the material properties. The product throughput was ultimately limited by this speed dependency.

Recent developments in the dewatering of lignite have utilised a method combining both thermal and mechanical treatments. This method, commonly known as the mechanical-thermal expression (MTE) process for dewatering high moisture brown coal and non-coal materials, requires that the coal be both heated and subjected to compression. The heating of the coal is typically achieved by injecting superheated steam into the coal. Pressure has typically been applied to the coal by use of a flat bed press, similar to those used in the manufacture of particle boards.

U.S. Pat. No. 4,702,745 discloses a process for dewatering coal by heating the coal in water at an elevated temperature and pressure in a heating chamber in order to reduce the moisture content of the coal. After pre-heating, the heated coal is subjected to compression by a compressing device while maintaining the temperature and the pressure of the water before lowering the pressure of the water in a decompressing chamber and then expelling a dewatered coal product. A problem with this dewatering process is that it can be difficult to feed the heated coal into the compressing device due to back-flow of material as the compressing device undergoes a compressing stroke and material is pushed back toward a heating vessel.

It is an aim of the present invention to provide a method and apparatus to facilitate feeding of a dewatering device and to ameliorate at least one or more disadvantages of the prior art.

SUMMARY OF THE INVENTION

Hereinafter, coal of reduced water content will be referred to as "dewatered coal".

According to a first aspect of the invention, there is provided a coal dewatering system comprising:

a preheater vessel having a chamber for heating coal, an inlet means to permit the passage of coal into the chamber, and an outlet means for permitting the passage of coal from the chamber;

heating means associated with the preheater vessel to heat coal contained in the chamber;

non-return valve means to substantially prevent heated coal removed from the preheater chamber via the outlet means from re-entering the pre-heater via the outlet means; and a dewatering unit adapted to receive the heated coal from the outlet means via the non-return valve means and to thereby dewater the coal.

According to a second aspect of the invention, there is provided a coal dewatering system comprising:

a preheater vessel having a chamber for heating coal, an inlet means to permit the passage of coal into said chamber, and an outlet means for permitting the passage of coal from said chamber;

heating means associated with the preheater vessel to heat coal contained in said chamber;

stirring means for stirring coal in the chamber and to intimately mix the coal; and a dewatering unit adapted to receive said heated coal from said outlet means and to thereby dewater said coal.

Preferably, the dewatering unit comprises a dewatering vessel having a coal containment volume, the coal containment volume having at least one side wall, at least a part of the at least one side wall having one or more apertures therein to allow passage of water there through, a dewatering inlet means for feeding coal to the coal containment volume, a dewatering outlet means for removing dewatered coal from the coal containment volume, a press movable in reciprocatory fashion along a line generally coincident with or generally parallel to a longitudinal axis of the dewatering vessel, wherein in use the press compresses coal in the vessel to express water from the coal and expressed water passes through the apertures in the at least one side wall of the coal containment volume.

The non-return valve means may comprise a movable valve means that can sit on a seating means, whereby movement of coal out of the preheater moves the valve means away from the seating means but movement of coal back towards the outlet means of the preheater moves the moveable valve means to a position where it is seated on the seating means to thereby prevent further flow of coal back into the preheater via the outlet means.

The preheater vessel may include a stirring means for stirring the coal in the chamber. The stirring means is preferably used to intimately mix coal, steam and optionally water to macerate the coal and form a flowable paste or slurry of coal.

The heating means can be a direct heating means or it can be an indirect heating means. The heating means may comprise a steam injection means for injecting steam into the chamber if it is a direct heating means or it may inject steam around the external surface of the chamber if it is an indirect heating means.

A fluid medium is optionally mixed with the coal to form a coal slurry or coal paste. The preheater vessel may be positioned above the dewatering unit so that preheated coal, coal paste or coal slurry from the preheater can flow under the influence of gravity to the dewatering unit. The flow of preheated coal, coal paste or coal slurry from the preheater may be controlled by the operation of filling and discharging of coal to and from the dewatering unit.

Feeder means may optionally be provided for feeding coal into the preheater chamber via the inlet means. The feeder means may be an extruder, a pressure lock arrangement or a screw auger.

The dewatering unit may optionally comprise:

a dewatering vessel having a coal containment volume, the coal containment volume having at least one side wall, at least a part of the at least one side wall having one or more apertures therein to allow passage of water there through, a dewatering inlet means for feeding coal to the coal containment volume, a dewatering outlet means for removing dewatered coal from the coal containment volume, a press movable in reciprocatory fashion along a line generally coincident with or generally parallel to a longitudinal axis of the dewatering vessel, wherein in use the press compresses coal in the vessel to express water from the coal and expressed water passes through the apertures in the at least one side wall of the coal containment volume. The dewatering unit may also comprises heating means to heat the coal in the coal containment volume.

The dewatering unit may also comprise sealing means for sealing the outlet means to thereby prevent coal passing through the outlet means during compression of the coal. The sealing means may comprises a second press or it may be any one of a valve, a plate, a sluice or a movable wall.

The first press and the second press may be positioned at opposed ends of the dewatering unit. The first and second presses may be any one of a hydraulic press, a pneumatic press or a mechanically operated press. The presses may also present a solid face to the coal.

The dewatering unit may be a pressure vessel adapted to be operated at an operating pressure such that steam injected into the vessel condenses on the coal. Preferably, the operating pressure of the dewatering unit is such that it prevents the evaporation of water from the coal. The preheater vessel may be operated at an operating pressure such that the steam condenses on the coal and prevents evaporation of water from the coal. The preheater vessel and the dewatering unit may be operated at substantially the same pressure.

The coal containment volume is preferably cylindrical in shape. However, it will be appreciated that other cross sectional shapes of the coal containment volume also fall within the scope of the present invention.

Advantageously, a substantial proportion of the walls of the coal containment volume have apertures therein to allow expressed water to be separated from the coal around almost all of the periphery of the coal containment volume.

The fluid medium may be supplied by a water injection means for injecting water into the chamber of the vessel. The water may be hot water expressed from the coal that has been subjected to dewatering by the dewatering apparatus.

According to a third aspect of the invention, there is provided an apparatus for feeding coal to a dewatering unit comprising:

a pressurised vessel having a chamber for heating coal therein;

an inlet means for supplying coal to the chamber of the pressurised vessel;

heating means for heating the coal in the chamber of the pressurised vessel;

stirring means for stirring the coal in the chamber and to intimately mix the coal; and outlet means through which coal can exit the pressurised vessel for passage to the dewatering unit.

According to a fourth aspect of the invention, there is provided an apparatus for feeding coal to a dewatering unit comprising:

a pressurised vessel having a chamber for heating coal;

an inlet means to permit the passage of coal into the chamber; and an outlet means to permit the passage of coal from the chamber;

heating means associated with the pressure vessel to heat coal contained in the chamber;

non-return valve means to substantially prevent heated coal, removed from the preheater chamber via the outlet means to the dewatering unit, from re-entering the pre-heater via the outlet means.

According to a fifth aspect of the invention, there is provided a coal dewatering method comprising the steps of:

(a) feeding coal to a preheater vessel having a chamber for heating coal, an inlet means to permit the passage of coal into the chamber, and an outlet means for permitting the passage of coal from the chamber;

(b) heating the coal contained in the chamber;

(c) providing a non-return valve means to substantially prevent heated coal, removed from the preheater chamber via the outlet means, from re-entering the pre-heater via the outlet means; and (d) dewatering the heated coal by applying pressure to the coal to express water from the coal in a dewatering unit, the heated coal being supplied to the dewatering unit from the outlet means via the non-return valve means.

The method may further comprise the step of:

(e) stirring said coal contained in said chamber to intimately mix said coal with a fluid medium to form a coal slurry or coal paste. The fluid medium may be superheated steam.

In one mode of operation, the dewatering unit optionally has a coal-containment volume defined in part by at least one side wall, at least a portion of the at least one side wall having one or more apertures therein to allow passage of water there though, the dewatering step may further comprise the steps of:

(f) maintaining the coal in the heated condition or heating the coal to an elevated temperature;

(g) compressing the coal by applying a first press that is movable along a line that is generally coincident with or generally parallel to a longitudinal axis of the coal containment volume to thereby express water from the coal, water expressed from the coal being passed out of the coal containment volume through the apertures in the at least a portion of the at least one side wall of the coal containment volume; and (h) removing coal of reduced water content from the coal containment volume.

In another mode of operation, the dewatering step may further provide the steps of:

(j) providing a second press with the dewatering unit, the second press being moveable along a line coincident with or parallel to the longitudinal axis of the coal containment volume;

(k) withdrawing the first and second presses from the coal containment volume to discharge dewatered coal from the coal containment volume and to charge heated coal from the preheater vessel into the coal containment volume;

(l) maintaining the coal supplied to the coal containment volume at a desired temperature for dewatering or further heating the coal to the desired temperature for dewatering;

(m) extending both the first and second presses into the coal containment volume to compress the coal and express water from the coal; and (n) repeating step (k) once a desired or predetermined level of dewatering of the coal has been achieved or after a predetermined residence time under pressure has been reached.

The dewatering of the coal may occur at an elevated pressure of about 5 bar to about 15 bar and at a temperature of about 150 degrees Celsius to about 200 degrees Celsius.

In one embodiment, the method may further include the step of:

(i) adding hot water to the chamber to form a coal paste or coal slurry. The hot water is provided from hot water expressed from the coal in the dewatering step.

The coal containment volume may have a filter material lining its side wall or walls. The filter material may be a mesh material and is preferably a metallic mesh material.

Optionally, the outlet of the coal containment volume or the dewatering vessel is closed by a plug of dewatered coal. To form the plug of dewatered coal, the start up phase of the method may require that a movable barrier be placed at the outlet of the coal containment volume or the dewatering vessel, once the outlet has been closed, coal is supplied to the coal containment volume and the first press is then operated in a first stroke to compress the coal. After the first stroke of the first press, the press may then be withdrawn and a further amount of coal supplied to the coal containment volume. Once the further amount of coal has been supplied, the first press may again be operated to perform a second successive stroke and further charging and compression cycles are repeated until a charge or plug of coal in the coal containment volume having increasing density and decreasing water content in a direction from the press (or inlet) to the outlet of the coal containment volume is established and a movable barrier at the opposite end of the coal containing volume to the first press is removed. Further cycles of press operation and coal charging may cause the plug of coal at the outlet to be forced out of, or extruded through, the outlet.

The present inventors have found that the second and further compression cycles result in further compression and dewatering of the coal and that a cumulative effect is noticed, that is to say that compressing the coal a number of times results in the effect of compression and dewatering of the coal increasing. After each compression stroke, the press is withdrawn and further coal supplied to the coal containment volume. Following a number of compression and coal supply cycles, a charge or plug of coal in the coal containment volume having increasing density and decreasing water content in a direction from the press (or inlet) to the outlet of the coal containment volume is established. When the density of the coal at the outlet is sufficiently high, the coal itself may act as a plug or closure for the outlet. The movable barrier may then be removed. Further cycles of press operation and coal supply will cause the plug of coal at the outlet to be forced out of, or extruded through, the outlet. Continuous operation is then established.

The discharge of the coal and the pressure let down caused by the discharge of the coal may be controlled by providing a ram at the outlet end that moves synchronously with the first press. The discharge of the coal and the pressure let down caused by the discharge of the coal may be controlled by providing an outlet having a controllable opening size, or having an outlet with a converging shape.

The outlet of the preheater vessel is optionally provided above both the non-return valve means, the non-return valve means being above a space in front of the press when the press is in a withdrawn position, wherein withdrawal of the first press to the withdrawn position enables coal to flow under gravity to a position in front of the press and extension of the press compresses supply to coal into the coal containment volume.

The method of supplying the coal in the embodiment of the present invention may comprise providing a feeding means having an outlet positioned above the press, said feeding means supplying coal to a space in front of the press when the press is in a withdrawn position.

The method of supplying the coal most preferably comprises providing a feed vessel above the press, the feed vessel arranged to supply coal to a space in front of the press when the press is in a withdrawn position, the feed vessel having an outlet means having a non-return valve means therein to allow coal to flow out of the feed vessel but to substantially prevent coal flowing back into the feed vessel via the outlet means, wherein withdrawal of the press to a withdrawn position enables coal to flow to a position in front of the press and extension of the press compresses supply to coal into the coal containment volume. The extension of the press may also close the non-return valve.

It is preferred that the coal is preheated such that coal at an elevated temperature is supplied to the dewatering vessel. Even if further heating is required in the dewatering vessel, the preheating step will reduce the heat-up time of the coal in the dewatering vessel which, in turn, will reduce the required residence time of the coal in the dewatering vessel. It is most preferred that the coal is preheated to such an extent that further heating of the coal in the dewatering vessel is not required. An advantage of this embodiment is that the cycle time or dewatering time is no longer dependent on the heating time in the dewatering vessel.

An advantage of the coal and steam being mixed under elevated pressure is that the latent heat released by the condensing of the steam is more uniformly distributed which results in a higher rate of heat transfer and a more uniform coal temperature.

In the method aspect of the present invention, the coal may be longitudinally compressed and the water removed in a direction transverse to the direction of pressing stop. The method of the first aspect of the present invention may be operated in a batch or semi-batch mode or in a continuous mode.

It may also be possible to operate the batch or semi-batch process using only a single press. In this embodiment, the second press may be replaced by a movable barrier, such as a movable wall, a valve or a sluice. The movable barrier is optionally closed when the coal is being heated in the coal containment volume and when the coal is being compressed by the press. Once the desired level of dewatering has been achieved, the moveable barrier is opened to allow the dewatered coal to be removed from the coal containment volume.

An advantage of the invention is that because the coal is preheated before entering the dewatering unit, further heating of the coal in the coal containment volume of the dewatering unit is not required. However, in some embodiments, the coal may also be heated in the coal containment volume, if desired.

It is preferred that the step of stirring the coal to mix it with the steam and optionally water causes some maceration of the coal and results in the formation of a coal paste or a coal slurry An advantage of having the coal macerated is that the maceration does not make the coal too fine as this could make it difficult to express the water from the coal in the dewatering stage of the process. Furthermore, the breakage of the coal caused by maceration should advantageously allow uniform heating of the coal.

An advantage of the preferred embodiment in which the apparatus is arranged such that the preheater is positioned above the dewatering unit and the preheated coal, coal paste or coal slurry from the preheater flows under the influence of gravity to the dewatering unit is that this arrangement ensures that flow of preheated coal, coal paste or coal slurry from the preheater is controlled by operation of the filling and discharging of coal to and from the dewatering unit. This might avoid the requirement of having separate, "positive action" flow control means associated with the outlet of the preheater. In other words, the outlet means of the preheater may be provided with passive flow control means in which operation is controlled by operation of the dewatering unit.

The preheater may further comprise feeder means for feeding coal thereto. The feeder means may be an extruder, a pressure lock arrangement, or indeed any other suitable feeder means.

BRIEF DESCRIPTION OF THE DRAWINGS

A non-limiting preferred embodiment of the invention will now be disclosed with reference to the following figures.

It will be appreciated that the drawings show preferred embodiments of the present invention. The drawings have been provided to illustrate the invention and the invention should not be considered as being limited to the specific embodiments shown in those drawings.

Figure 1:
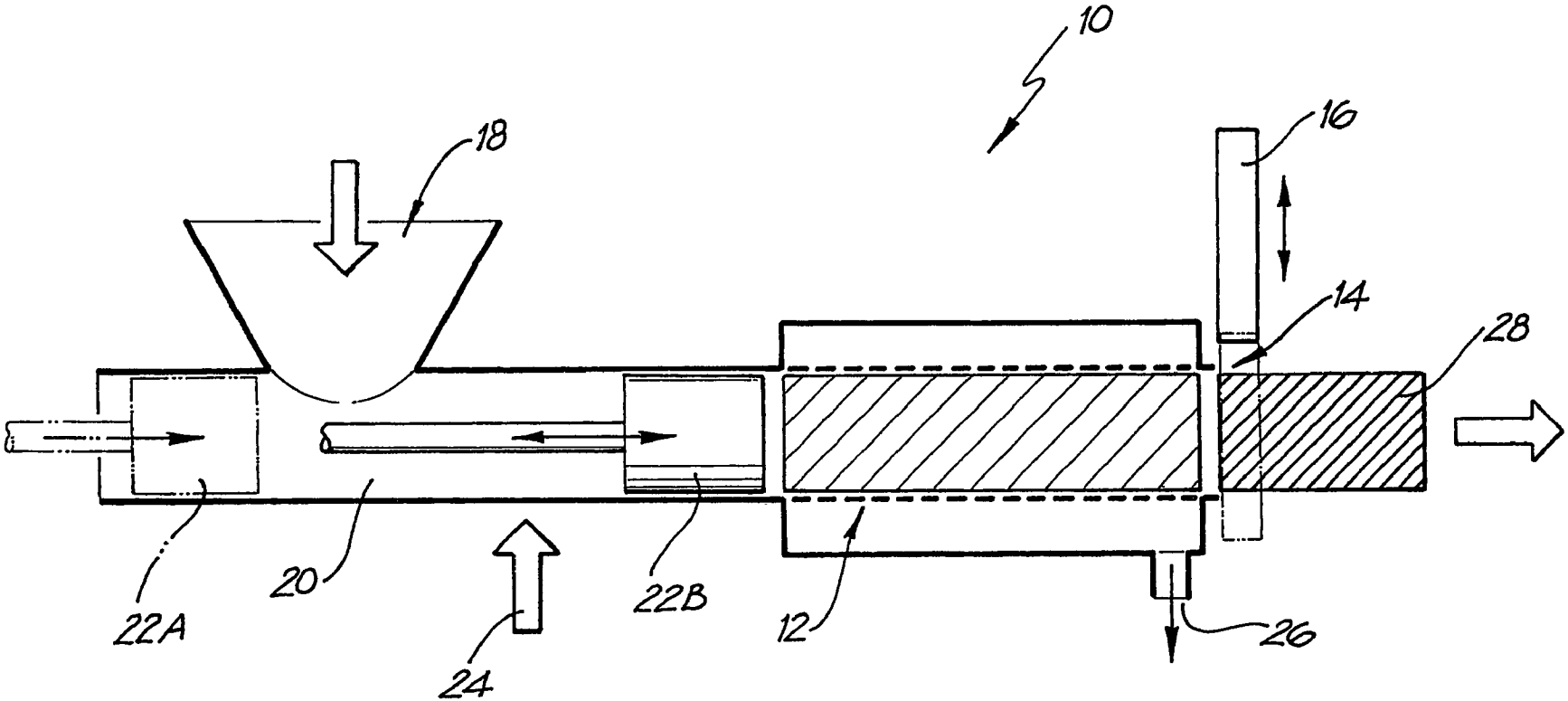
FIG. 1 shows a schematic side elevation, in cross section, showing an apparatus in accordance with a preferred embodiment of the invention for use in a batch mode.

FIG. 1 shows a schematic side elevational view in cross-section of an apparatus in accordance with a preferred embodiment of an aspect of the present invention for use in the dewatering of coal in a batch mode. The apparatus comprises a dewatering vessel 10 having a coal containment volume 12 therein. Coal containment volume may suitably be formed by placing a hollow cylinder of a foraminate material into dewatering vessel 10. The dewatering vessel 10 includes an outlet 14 through which dewatered coal is discharged. A moveable barrier in the form of a gate valve 16 can be operated to selectively close and open outlet 14.

Figure 3:
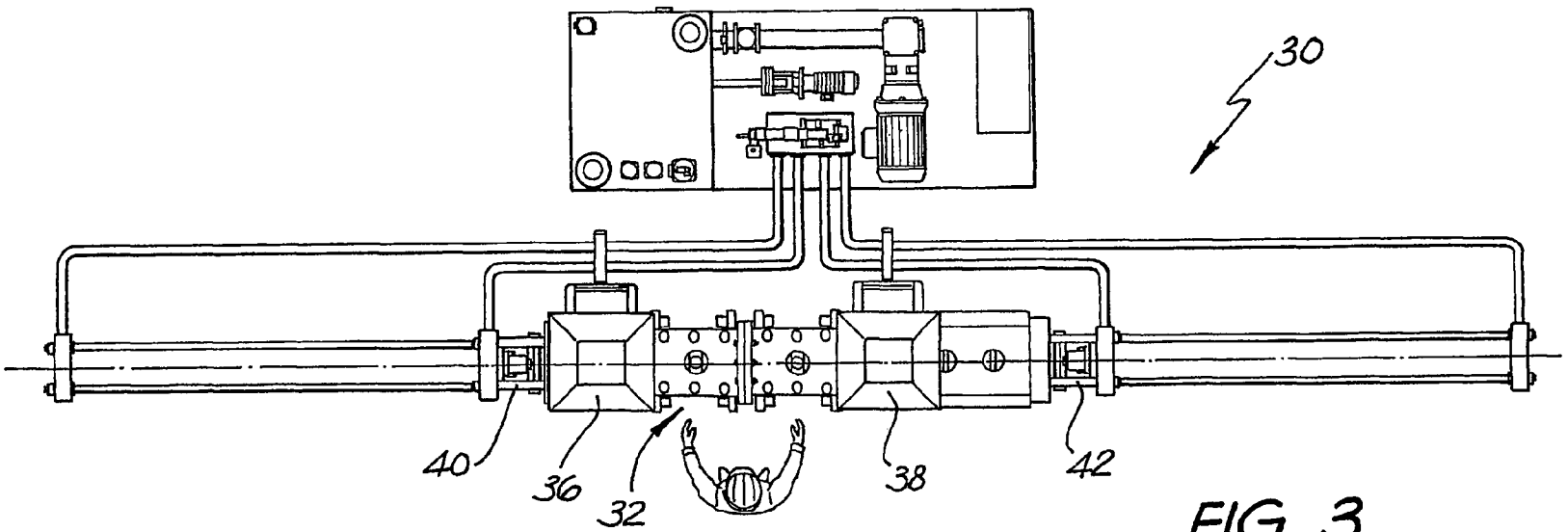
FIG. 3 is a plan view of a physical apparatus in accordance with the schematic diagram shown in FIG. 2.
Figure 4:
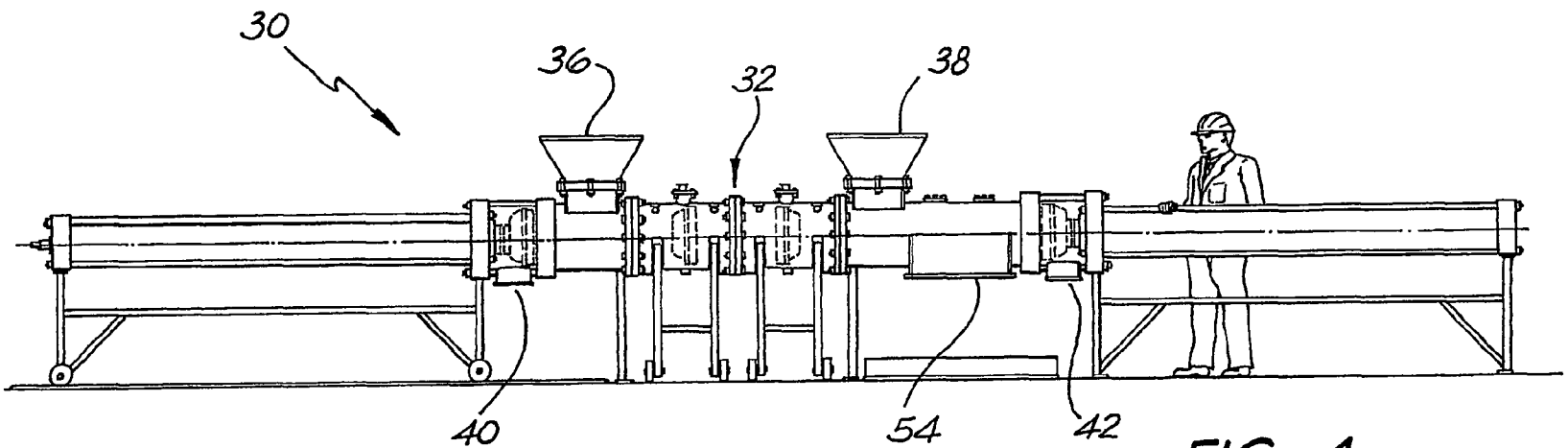
FIG. 4 is a front elevation of FIG. 3.

The apparatus shown in FIG. 1 further includes a coal feeding means 18, an example of which will be described further with reference to FIG. 3 and FIG. 4. Coal feeding means 18 opens into a passageway 20 that is formed as an extension of dewatering vessel 10. A press, shown schematically at 22*a* and 22*b*, can move in a reciprocating motion along a line that is generally coincident with the longitudinal axis of coal containment volume 12.

In operation of the apparatus shown in FIG. 1, the press is moved to the position shown by reference numeral 22*b*. In this position, the press is in a withdrawn or retracted state. Gate valve 16 is closed to close the outlet 14 of dewatering vessel 10. Preheated coal is supplied from coal feeding means 18 into passageway 20. The press is operated to lightly compress the coal. The coal may be further heated by heat supplied by injecting steam through steam injecting means, shown schematically by reference numeral 24, although the most preferred embodiment of the invention does not require any further heating in the dewatering vessel 10. If the coal is further heated in dewatering vessel 10, the heating of the coal should take place under pressure so that the steam injected into the coal condenses and also to prevent evaporation of water in the coal. It will be understood that evaporation of the water will adversely affect the heating efficiency of the process.

Once the coal has been heated to the desired temperature, the press is operated to compress the coal. In particular, the press is moved to a position shown by reference numeral 22*b* and is then further operated to further compress the coal in the coal containment volume 12. This compression of the coal causes water to be expressed from the coal. The water that has been expressed passes through the foraminate wall of the coal containment volume and is discharged as waste water through waste water outlet 26.

After the coal has been dewatered to the desired extent, gate valve 16 is opened and the press is operated such that it extends ether towards the outlet 14 of dewatering vessel 10. This further extension of the press pushes the dewatered coal (shown schematically by reference numeral 28) through the outlet 14. The press 22 is then withdrawn to the position shown by reference numeral 22*a* and the cycle can commence again by feeding coal through coal feeding means 18 into passageway 20.

Figure 2:
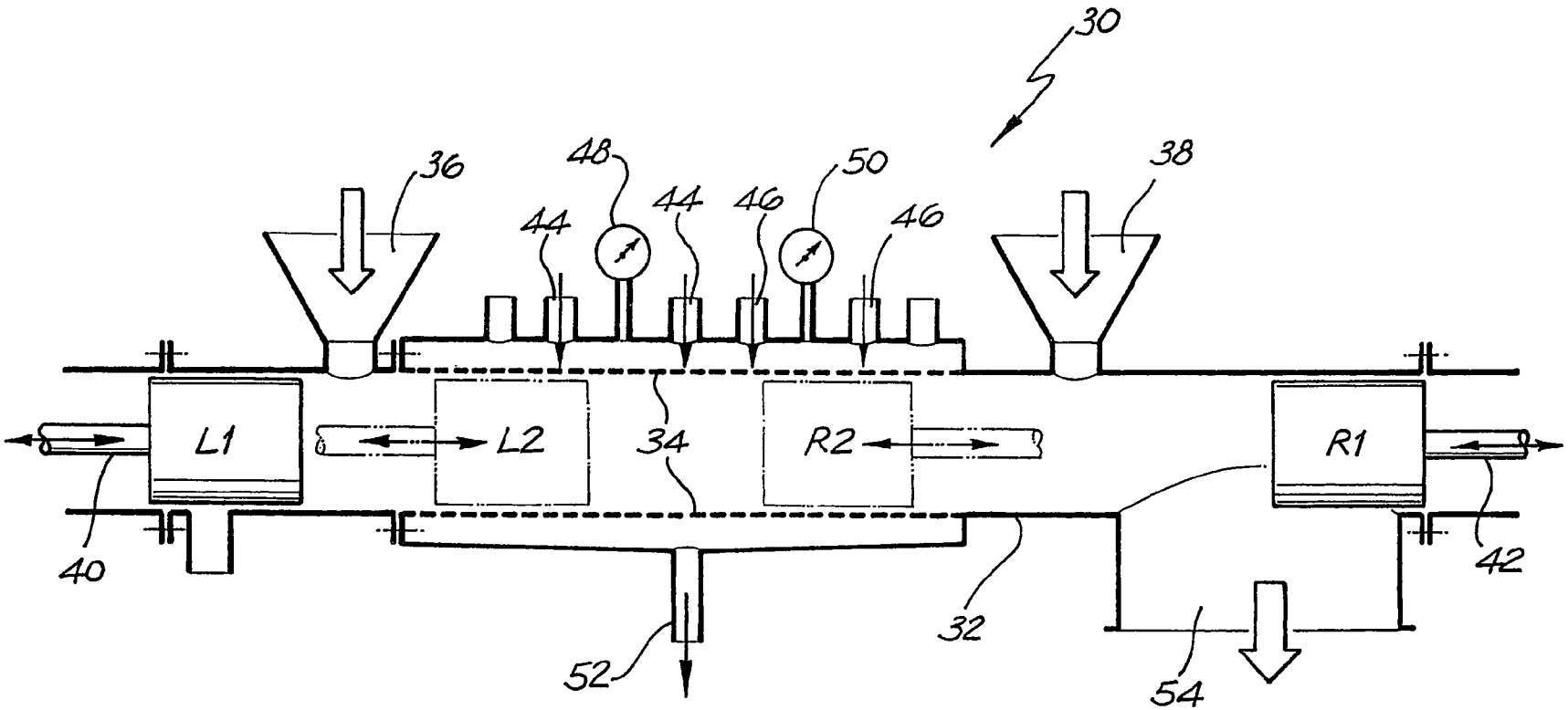
FIG. 2 is a schematic diagram in cross section showing another apparatus in accordance with another preferred embodiment of the present invention for use in a batch operation.

FIG. 2 shows another embodiment of an apparatus in accordance with the present invention, which apparatus has been designed primarily for use in a batch mode. The apparatus 30 of FIG. 2 comprises a dewatering vessel 32. A porous filter wall 34, which defines the coal containment volume, is provided inside dewatering vessel 32. Two coal feeding means 36, 38 are provided at either side of the coal containment volume. A first press 40 and a second press 42 are able to extend and be withdrawn along a line of direction that is generally coincident with the longitudinal access of the coal containment volume.

In other embodiments the coal containment volume 12 may be lined with a filter mesh material such as a metallic mesh material.

The apparatus shown in FIG. 2 may also include steam injection means 44, 46 for injecting steam into the coal in the coal containment volume. Pressure gauges 48, 50 are also provided to monitor the pressure within the dewatering vessel.

The apparatus also includes a water outlet 52 for discharging the water expressed from the coal and a dewatered coal outlet 54 for discharging dewatered coal.

In operation of the apparatus shown in FIG. 2, first press 40 and second press 42 are withdrawn to the positions shown by reference numerals L1 and R1, respectively. Coal is then fed through respective coal feeding means 36, 38. First press 40 is then extended to move from the position shown by reference numeral L1 to the right, which results in first press 40 pushing the coal delivered to the apparatus 30 by coal feeding means 36 into the coal containment volume. Similarly, second press 42 is moved from the position shown at R1 to the left to push the coal supplied through coal feeding means 38 into the coal containment space.

The initial operation of first press 40 and second press 42 moves the coal into the coal positioning volume and lightly compresses the coal. Steam may then be injected into the coal through steam injection means 44, 46, although it is more preferred that the coal is sufficiently preheated to avoid having to inject steam into the dewatering vessel 32. If steam injection is utilised, the coal is held by the first press 40 and second press 42 under pressure, the injected steam can condense on the coal to thereby heat the coal. The operating pressure of the dewater vessel 32 should be such that the evaporation of water in the coal is prevented.

Once the coal has been heated to a desired temperature, which preferably falls within the range of 150-200° C., first press 40 and second press 42 are further extended to compress the coal. This causes first press 40 and second press 42 to move to the respective positions shown by reference numerals L2 and R2 in FIG. 2. The pressure applied to the coal causes water in the coal to be expressed. Expressed water is removed from the dewatering vessel 32 via water outlet 52.

Once the coal has been dewatered to a desired extent, second press 42 is withdrawn to the position shown by reference numeral R1 in FIG. 2. First ram 40 is then further extended to push the dewatered plug of coal to the right through coal containment volume and dewatering vessel 32 until the plug of dewatered coal is positioned in alignment with dewatered coal outlet 54. The dewatered coal can then be removed from the apparatus 30. First press 40 is then withdrawn to the position shown by reference numeral L1 in FIG. 2 and the cycle recommences by feeding of coal to the apparatus 30 through coal feeding means 36 and 38. The cycle is then repeated.

Figure 5:
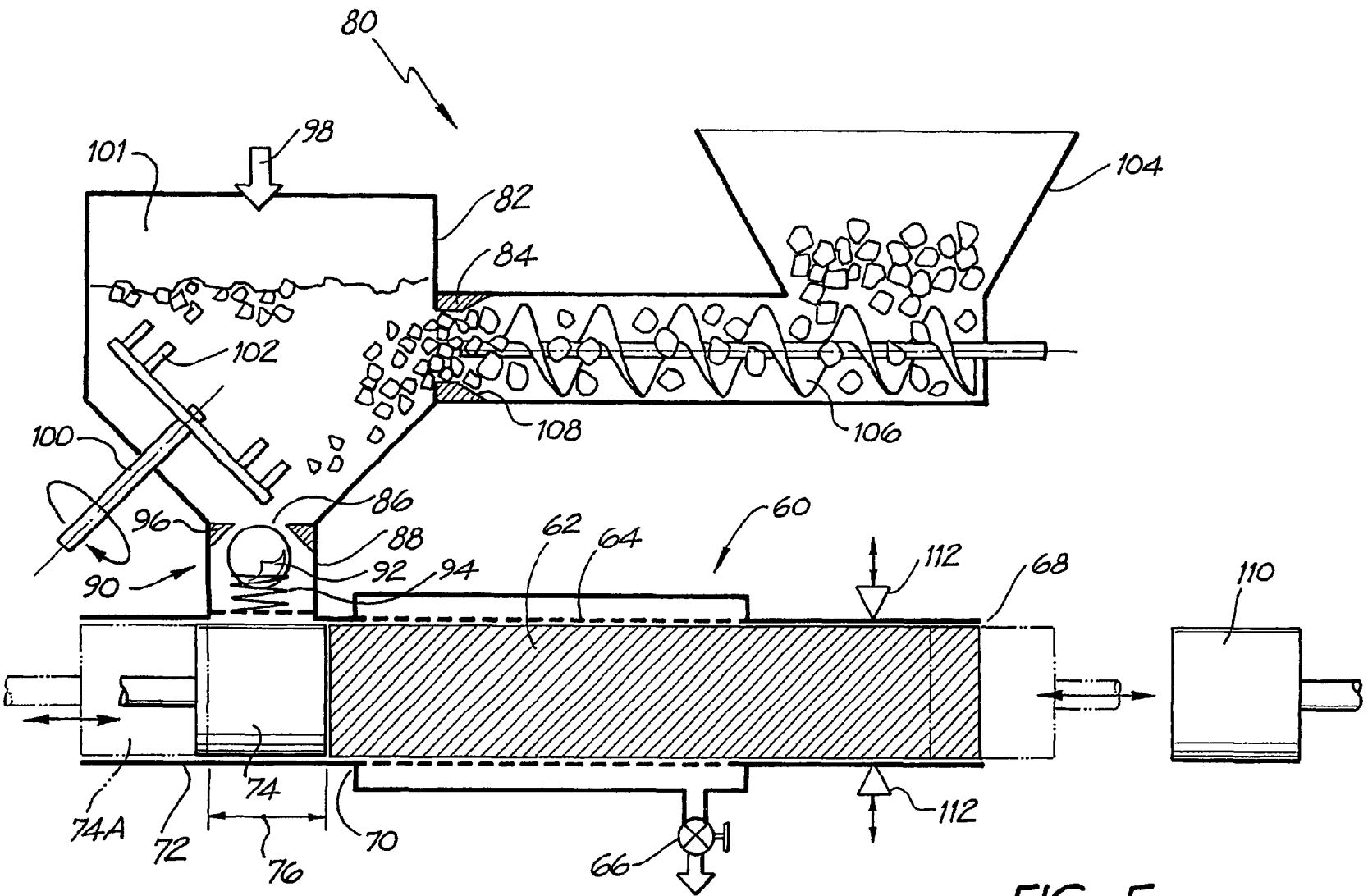
FIG. 5 is a schematic view in cross section of an apparatus in accordance with a preferred embodiment of the invention for use in a continuous mode.

FIG. 5 shows another embodiment of a coal dewatering system in accordance with the present invention. The apparatus shown in FIG. 5 has been primarily designed to be used in a continuous mode. The apparatus of FIG. 5 comprises a dewatering unit in the firm of dewatering vessel 60 having a coal containing volume 62 defined by a cylindrical foraminate wall 64. The coal containment volume 62 may have a filter material lining the cylindrical foraminate wall 64. Alternatively, the cylindrical foraminate wall 64 may have apertures sufficiently small to prevent the egress of coal there through.

Dewatering 60 includes a water discharge 66 for removing water expressed from the coal. The dewatering vessel 60 has an outlet 68 through which dewatered coal can be discharged. The dewatering vessel 60 also has an inlet 70 through which coal can be supplied to the coal containing volume 62.

The inlet end of dewatering vessel 60 includes a passageway 72 along which a press 74 can travel. Press 74 comprises a solid cylindrical press that is hydraulically actuated to move in a reciprocating fashion along a line that is generally coincident with the longitudinal axis of the coal containing volume 62. The extent of travel of press 74 is shown by double headed arrow 76.

The apparatus shown in FIG. 5 also includes a feeding means denoted generally by reference numeral 80. The feeding means 80 includes a preheater vessel in the form of pressure vessel 82 having an inlet 84 that provides an inlet for coal to be deposited into a chamber 101. The pressure vessel 82 also includes an outlet 86 from the chamber 101 that feeds into a conduit 88 that is connected to passageway 72 of the dewatering apparatus. A non-return valve 90 is provided in the outlet 86 and conduit 88. The non-return valve 90 includes a floating ball 92 that rests in a ball support 94. The non-return valve 90 also includes seating means 96 upon which the floating ball 92 seats in the event that coal is forced to travel upwardly through conduit 88.

The pressure vessel 82 also includes a heating means in the form of steam injection means 98. A stirrer 100 is also provided in the pressure vessel 82. Stirrer 100 includes paddles 102 that act to stir the coal and to intimately mix the coal and steam in the chamber 101 of the pressure vessel 82. The pressure vessel may also include water injection means for injecting water into the chamber 101 of the pressure vessel 82. The water is suitably hot water expressed from the coal in dewatering vessel 62.

In order to feed coal through the inlet 84 into the chamber 101 of the pressure vessel 82, coal from a hopper 104 is fed via a screw auger or screw feeder 106. Screw feeder 106 has a convergent outlet 108. As a result, as the coal is fed along screw feeder 106 and out through convergent outlet 108, pressure is applied to the coal. Accordingly, the coal is fed to the chamber 101 of pressure vessel 82 under pressure and this allows the coal to act as a lock or plug in inlet 84 to pressure vessel 82. Thus, steam under pressure can be injected through steam injection means 98 directly into the chamber; of 101 pressure vessel 82. Alternatively7 the chamber 101 may have a hollow shell covering the external walls of chamber 101 and steam maybe injected around the hollow shell to indirectly heat coal in the chamber 101.

Operation of the apparatus shown in FIG. 5 will now be described. Coal in hopper 104 is fed via screw feeder 106 into the inlet 84 of pressure vessel 82. The screw feeder 106 feeds the coal into the chamber 101 under pressure. Steam is injected through steam injection means 98 into chamber 101 and stirrer 100 and paddles 102 stir the coal in the chamber 101 and intimately mix the coal with the steam. The stirrer 100 and paddles 102 also macerate the coal and result in the formation of a heated slurry of coal and water. The chamber 101 is operated at a pressure equal to the saturation pressure of steam at the desired temperature. To obtain a temperature of 150-200° C. in the coal, chamber 101 is suitably operated at a pressure of between 5 and 15 bar.

During start-up of the apparatus shown in FIG. 5, ram 110 is extended until it is positioned adjacent the outlet of coal containing volume 62. Press 74 is then withdrawn to the position shown by reference numeral 74*a* in FIG. 5. In this position, press 74 is positioned to the left of conduit 88. Accordingly, conduit 88 is effectively opened and coal slurry from pressure vessel 82 can flow down through outlet 86 in conduit 88 into the passageway 72. Once coal slurry has stopped flowing from pressure vessel 82, press 74 is extended from the position denoted by reference numeral 74*a* to an extended position shown in FIG. 5 by reference numeral 74 and the press being drawn in solid outline. During extension of press 74, coal slurry may tend to flow upwardly through conduit 88. If this does occur, floating ball 92 seats on seating means 96 to thereby prevent the inflow of coal slurry into pressure vessel 82.

Extension of the press 74 also pushes the coal to the right into the coal containment volume 62. As ram 110 is positioned adjacent the outlet of coal containment volume 62, the coal cannot pass out of the coal containment volume 62 at this stage.

Press 74 is then retracted or withdrawn to the position shown by the outline of 74*a*, which results in further coal slurry flowing from pressure vessel 82 into passageway 72. Press 74 is then positioned to its extended position as described above, which pushes the newly supplied coal slurry in passageway 72 into coal containing volume 62. This next stroke of the ram 74 also has the effect of further compressing the coal already in the coal containment volume 62. Further repeating of the retraction, coal slurry feeding and press extension cycles results in further coal being pushed into coal containment volume 62 and further compression of the coal in coal containment volume 62 taking place.

Once the coal adjacent the outlet end of coal containments volume 62 has been dewatered to a desired degree, the ram 110 is gradually retracted. Subsequent cycles of retraction and extension of press 74 then cause the dewatered coal to pass through the outlet of coal containing volume 62. It will be appreciated that the coal that has been positioned adjacent the outlet of coal containing volume 62 has been substantially compacted and can form a compressed bed of coal that is essentially impermeable to steam and pressure, thereby acting as a plug or closure in the outlet of the coal containing volume 62.

Continued operation of the apparatus shown in FIG. 5 results in the dewatered coal being extruded through the outlet 68 of dewatering vessel 60. The dewatered coal may then be discharged from the apparatus.

It is possible that difficulties may be encountered in controlling the discharge of dewatered coal from the dewatering vessel 60. Discharge of the coal involves a pressure let down. Therefore, the resistance to flow to allow the compression force to discharge the dewatered coal may need to be controlled. If this proves to be so, pressure control means 112 may act to vary or regulate the pressure on the dewatered coal being discharged from the dewatering vessel 60. Alternatively, or at the same time, ram 110 may be operated to control the resistance to flow.

The coal in coal containing volume 62 may also be heated by indirect heating means. In some embodiments, it is not necessary to further heat the coal in dewatering vessel 62 and this is the preferred embodiment of the invention. In such embodiments, the dewatering vessel 62 should be lagged or insulated to minimise heat loss and maintain temperature. It will also be appreciated that the coal in coal containing volume 62 is under pressure so that evaporation of the water expressed from the coal may be avoided.

The apparatus shown in FIG. 5 utilises reciprocating motion of the press 74 to allow feed coal to enter the dewatering vessel and to cause compression of the coal necessary for dewatering to take place.

Figure 6:
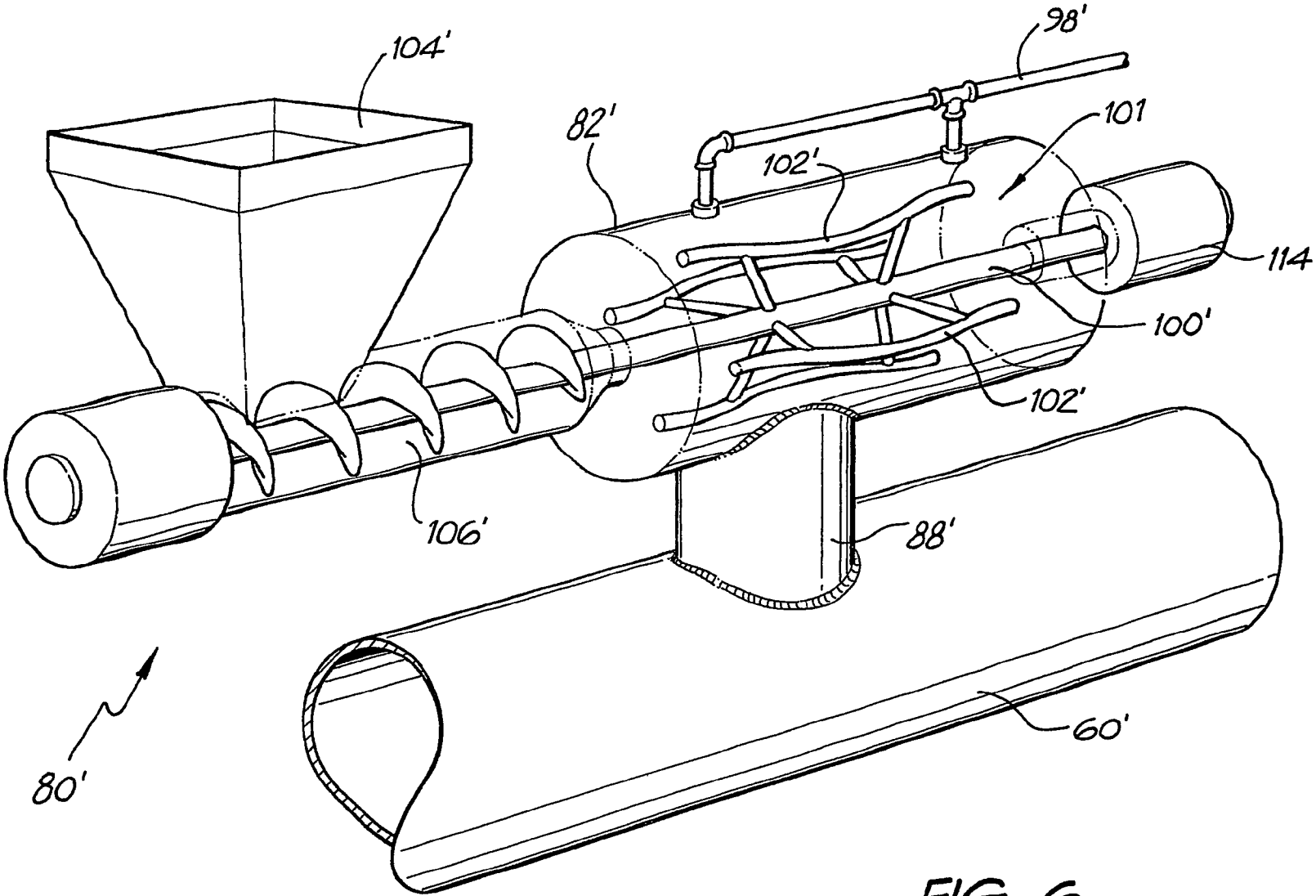
FIG. 6 is a perspective view of an apparatus in accordance with a preferred embodiment of the present invention.

FIG. 6 shows a perspective sketch of an apparatus that is similar to that shown in FIG. 5. Where the features of FIG. 6 are common with those of FIG. 5, FIG. 6 uses the same reference numeral with a prime added thereto. The apparatus of FIG. 6 includes a dewatering apparatus comprising a dewatering vessel 60' and associated equipment that is essentially similar to the dewatering apparatus shown in FIG. 5.

Coal is fed from a hopper 104' via a screw feeder 106' into chamber 101 of pressure vessel 82'. The pressure vessel 82' includes steam injection means 98' for injecting steam (preferably super-heated) into chamber 101. A stirrer 100', which includes paddles 102' is fixed inside pressure vessel 82'. Stirrer 100' is actuated by a drive motor 114.

The feeding means 80 and 80' shown in FIGS. 5 and 6 may be used in conjunction with any method for dewatering coal. Studies conducted by the present inventors have shown that the heating step of the coal dewatering process is typically the rate limiting step of the process. Therefore, use of the feeding means to preheat the coal decouples the heating step from the total cycle time for dewatering the coal. This can lead to substantial reductions in the cycle time for dewatering of coal using mechanical-thermal expression dewatering processes. Effectively, the heating and compression steps are taking place in parallel rather than in series, which occurred in prior art processes. This is especially so in embodiments of the invention where there is no heating of the coal taking place in the dewatering vessel. The apparatus may also be designed to ensure that an adequate supply of fully preheated coal is available to feed to the dewatering vessel.

It will be appreciated that because the pressure vessel 82 is above the dewatering vessel 60, the preheated coal, coal paste or coal slurry can advantageously flow under the influence of gravity.

In other embodiments, the screw feeder 106 could be replaced by an extruder or by a pressure lock arrangement. Further, ram 110 in FIG. 5 could be replaced by another form of sealing means such as a valve, a plate, a sluice or a moveable wall. Additionally, it will be appreciated that the press 74 and/or the ram 110 may be any one of a hydraulic press, a pneumatic press or a mechanically operated press.

The invention has also been described as being used for the dewatering or preheating of coal. However, it will be appreciated that the invention can be used in the treatment of any material, especially carboniferous materials, that are suitable to be dewatered by a mechanical-thermal expression dewatering techniques. Such materials may include heat, wood pulp, wood chip, sewerage sludge and the like. Accordingly, the present invention should not be considered to be limited solely to treatment of coal and reference to coal' shall be taken to encompass other materials as well.

Those skilled in the art will appreciate that the present invention may be susceptible to variations and modifications other than those specifically described. It is to be understood that the present invention encompasses all such variations and such modifications that fall within its spirit and in scope.

The invention claimed is:

1. A coal dewatering system comprising:

a preheater vessel having a chamber for heating coal, an inlet means to permit the passage of coal into said chamber, and an outlet means for permitting the passage of coal from said chamber;

heating means associated with the preheater vessel to heat coal contained in said chamber;

to intimately mix the coal; and a dewatering unit adapted to receive said heated coal from said outlet means and to thereby dewater said coal, the dewatering unit comprising:

a dewatering vessel having a coal containment volume, said coal containment volume having at least one side wall, at least a part of the at least one side wall having one or more apertures therein to allow passage of water therethrough, a dewatering inlet means for feeding coal to the coal containment volume, a dewatering outlet means for removing dewatered coal from the coal containment volume, the dewatering system characterized by the dewatering vessel comprising a press moveable in reciprocatory fashion along a line generally coincident with or generally parallel to a longitudinal axis of the dewatering vessel, wherein in use said press compresses coal in said vessel to express water from the coal and the expressed water passes through the apertures in the at least one side wall of the coal containment volume and a sealing means for sealing the outlet means to thereby prevent coal passing through the outlet means during compression of the coal.

2. A coal dewatering system as claimed in claim 1, wherein the dewatering unit comprises heating means to heat the coal in the coal containment volume.

3. A coal dewatering system as claimed in claim 1, wherein the sealing means comprises a second press.

4. A coal dewatering system as claimed in claim 3, wherein the sealing means comprises at least one selected from the group consisting of a valve, a plate, a sluice or a movable wall.

5. A coal dewatering system as claimed in claim 3, wherein the first press and the second press are positioned at opposed ends of the dewatering unit.

6. A coal dewatering system as claimed in claim 3, wherein the dewatering unit is a pressure vessel adapted to be operated at an operating pressure such that steam injected into the vessel condenses on the coal.

7. A coal dewatering system as claimed in claim 3, wherein the operating pressure of dewatering unit is such that it prevents the evaporation of water from the coal.

8. A coal dewatering system as claimed in claim 3, wherein the second press is selected from the group consisting of a hydraulic press, a pneumatic press or a mechanically operated press.

9. A coal dewatering system as claimed in claim 3, wherein the presses present a solid face to the coal.

10. A coal dewatering system as claimed in claim 1, wherein said preheater vessel is a pressure vessel.

11. A coal dewatering system as claimed in claim 1, wherein the coal containment volume is substantially cylindrical in shape.

12. A coal dewatering system as claimed in claim 1, wherein a substantial proportion of the walls of the coal containment volume have apertures therein to allow expressed water to be separated from the coal around almost all of the periphery of the coal containment volume.

13. A coal dewatering system as claimed in claim 1, wherein the press is selected from the group consisting of a hydraulic press, a pneumatic press or a mechanically operated press.

14. A coal dewatering system as claimed in claim 1, wherein the means to intimately mix the coal intimately mixes coal, steam and water to form a flowable paste or slurry of coal.

* * * * *